US005652572A

United States Patent [19]

Kido et al.

[11] Patent Number: 5,652,572

[45] Date of Patent: Jul. 29, 1997

[54] RADIO PAGER CAPABLE OF DISPLAYING FIXED SENTENCES

[75] Inventors: Toru Kido; Ichiro Ozaki, both of Tokyo, Japan

[73] Assignee: NEC Corporation, Tokyo, Japan

[21] Appl. No.: 607,230

[22] Filed: Feb. 26, 1996

Related U.S. Application Data

[63] Continuation of Ser. No. 219,724, Mar. 29, 1994, abandoned.

[30] Foreign Application Priority Data

Mar. 30, 1993 [JP] Japan ..... 5-071451

[51] Int. Cl.[6] ..... G08B 5/22

[52] U.S. Cl. ..... 340/825.44; 455/38.4; 455/566

[58] Field of Search ..... 340/825.44, 825.26, 340/825.27, 311.1; 379/57, 269, 214; 370/110.1; 395/149

[56] References Cited

U.S. PATENT DOCUMENTS

| | | | |
|---|---|---|---|
| 4,336,524 | 6/1982 | Levine | 340/825.44 |
| 4,382,256 | 5/1983 | Nagata | 340/825.44 |
| 4,839,628 | 6/1989 | Davis et al. | 340/311.1 |
| 4,894,649 | 1/1990 | Davis | 340/825.44 |
| 5,025,252 | 6/1991 | De Luca et al. | 340/825.44 |
| 5,066,949 | 11/1991 | Breeden et al. | 340/825.44 |
| 5,173,688 | 12/1992 | De Luca et al. | 340/825.44 |
| 5,247,519 | 9/1993 | Snowden et al. | 340/825.44 |
| 5,257,307 | 10/1993 | Ise | 379/57 |
| 5,359,317 | 10/1994 | Gomez et al. | 340/825.44 |
| 5,561,702 | 10/1996 | Lipp et al. | 340/825.44 |
| 5,574,439 | 11/1996 | Miyashita | 340/825.44 |

FOREIGN PATENT DOCUMENTS

| | | | |
|---|---|---|---|
| 0317230A3 | 5/1989 | European Pat. Off. | G08B 3/10 |
| 0502419A3 | 9/1992 | European Pat. Off. | G08B 5/22 |
| 0509781A3 | 10/1992 | European Pat. Off. | H04Q 7/02 |
| 0520514A3 | 12/1992 | European Pat. Off. | G08B 5/22 |
| 2634607 | 1/1990 | France | H04B 7/26 |
| 2127825 | 8/1988 | Japan | H04B 7/26 |
| 2127825 | 5/1990 | Japan | G08B 3/10 |
| WO9014646 | 11/1990 | WIPO | G08B 5/22 |
| 9016052 | 12/1990 | WIPO | 340/825.44 |

OTHER PUBLICATIONS

European Search Report No Date.

IBM Technical Disclosure Bulletin, vol. 32 No. 9B Feb. 1990 (2 pages).

*Primary Examiner*—Michael Horabik

*Assistant Examiner*—Edward Merz

*Attorney, Agent, or Firm*—Whitham, Curtis, Whitham & McGinn

[57] ABSTRACT

A radio pager capable of displaying a message implemented as a fixed sentence includes a radio section for receiving and demodulating a paging signal. A first storage stores a plurality of address numbers allocated to the pager, and a comparing section compares an address number included in the demodulated paging signal with each of the address numbers stored in the first storage, and outputs, if the address number included in the demodulated paging signal is identical with any of the address numbers stored in the first storage, the address number included in the demodulated paging signal as an address number assigned to the pager while writing message data following the address number in a message memory. A second storage stores a plurality of tables each listing a particular kind of fixed sentences. A third storage stores correspondence between the address numbers allocated to the pager and the tables. A message processing section selects, based on the stored correspondence, one of the tables corresponding to the address number assigned to the pager, and selects one of the fixed sentences corresponding to the message data written to the message memory on the basis of stored correspondence. A display section displays the fixed sentence selected.

9 Claims, 6 Drawing Sheets

13
ADDRESS NUMBER AREA
FIXED SENTENCE DATA AREA
131
132
11
RADIO
12
DECODER
16
M P U
17
L C D DRIVER
18
L C D
14
R A M
15
FIXED SENTENCE AREA
151
19
SPEAKER DRIVER
20

Fig. 2

151

| | ADDRESS | DATA | |
|---|---|---|---|
| | | | |
| | h | | k |
| | i | | l |
| | j | | m |
| | ⋮ | | ⋮ |
| TABLE 1 | k | FIXED SENTENCE | k [1] |
| | k + 1 | FIXED SENTENCE | k [2] |
| | k + 2 | FIXED SENTENCE | k [3] |
| | ⋮ | | ⋮ |
| | k + d − 1 | FIXED SENTENCE | k [d] |
| | ⋮ | | ⋮ |
| TABLE 2 | l | FIXED SENTENCE | l [1] |
| | l + 1 | FIXED SENTENCE | l [2] |
| | ⋮ | | ⋮ |
| | l + θ − 1 | FIXED SENTENCE | l [e] |
| | ⋮ | | ⋮ |
| TABLE 3 | m | FIXED SENTENCE | m [1] |
| | m + 1 | FIXED SENTENCE | m [2] |
| | ⋮ | | ⋮ |
| | m + f − 1 | FIXED SENTENCE | m [f] |
| | ⋮ | | ⋮ |
| | | | |

15

RADIO PAGER CAPABLE OF DISPLAYING FIXED SENTENCES

This application is a continuation of U.S. patent application Ser. No. 08/219,724, filed Mar. 29, 1994, now abandoned.

BACKGROUND OF THE INVENTION

The present invention relates to a radio pager and, more particularly, to a radio pager capable of displaying messages implemented as fixed sentences.

Radio pagers available today include one storing a plurality of address numbers assigned thereto and capable of displaying fixed sentences. This type of pager stores fixed sentences and sentence numbers corresponding one-to-one to the fixed sentences. As an operator at a calling station enters the address number of a particular receiver and then a number representative of a desired sentence, the receiver displays a fixed sentence corresponding to the sentence number which follows the address number. The sentence number, which is a numeral or numerals, allows a message in, for example, Japanese katakana to be transferred from the calling station to the receiver. Japanese Patent Laid-Open Publication No. 2-127825, for example, discloses a radio pager having a liquid crystal display which flashes or reverses black and white for each of the plurality of address numbers.

The conventional pager of the type described can select any one of the fixed sentences registered thereat without regard to the address number used to send a message to the user. All the sentences registered at the pager are candidates for message display. However, such a pager is apt to display an unexpected fixed sentence due to, for example, an incorrect sentence number inadvertently entered at the calling station and propagation troubles, e.g., wave interference and fading. For example, it is likely that "Charge is unpaid", which is an exclusive fixed message to be sent by the operator to a user, is sent by accident.

SUMMARY OF THE INVENTION

It is, therefore, an object of the present invention to provide a radio pager capable of limiting, on receiving one of a plurality of address numbers, the kind of fixed sentences which can be displayed.

A radio pager capable of displaying a message implemented as a fixed sentence of the present invention comprises a radio section for receiving and demodulating a paging signal, a first storage storing a plurality of address numbers allocated to the pager, a comparing section for comparing an address number included in the demodulated paging signal with each of the address numbers stored in the first storage, and outputting, if the former is identical with any one of the latter, the former as an address number assigned to the pager while writing message data following the address number in a message memory, a second storage storing a plurality of tables each listing a particular kind of fixed sentences, a third storage storing correspondence between the address numbers allocated to the pager and the tables, a message processing section for selecting, based on the stored correspondence, one of the tables corresponding to the address number assigned to the pager, and selecting one of the fixed sentences corresponding to the message data written to the message memory on the basis of stored correspondence, and a display section for displaying the fixed sentence selected.

BRIEF DESCRIPTION OF THE DRAWINGS

The above and other objects, features and advantages of the present invention will become more apparent from the following detailed description taken with the accompanying drawings in which:

FIG. 2 shows fixed sentences stored in a format particular to the present invention;

DESCRIPTION OF THE PREFERRED EMBODIMENTS

Figure 6:
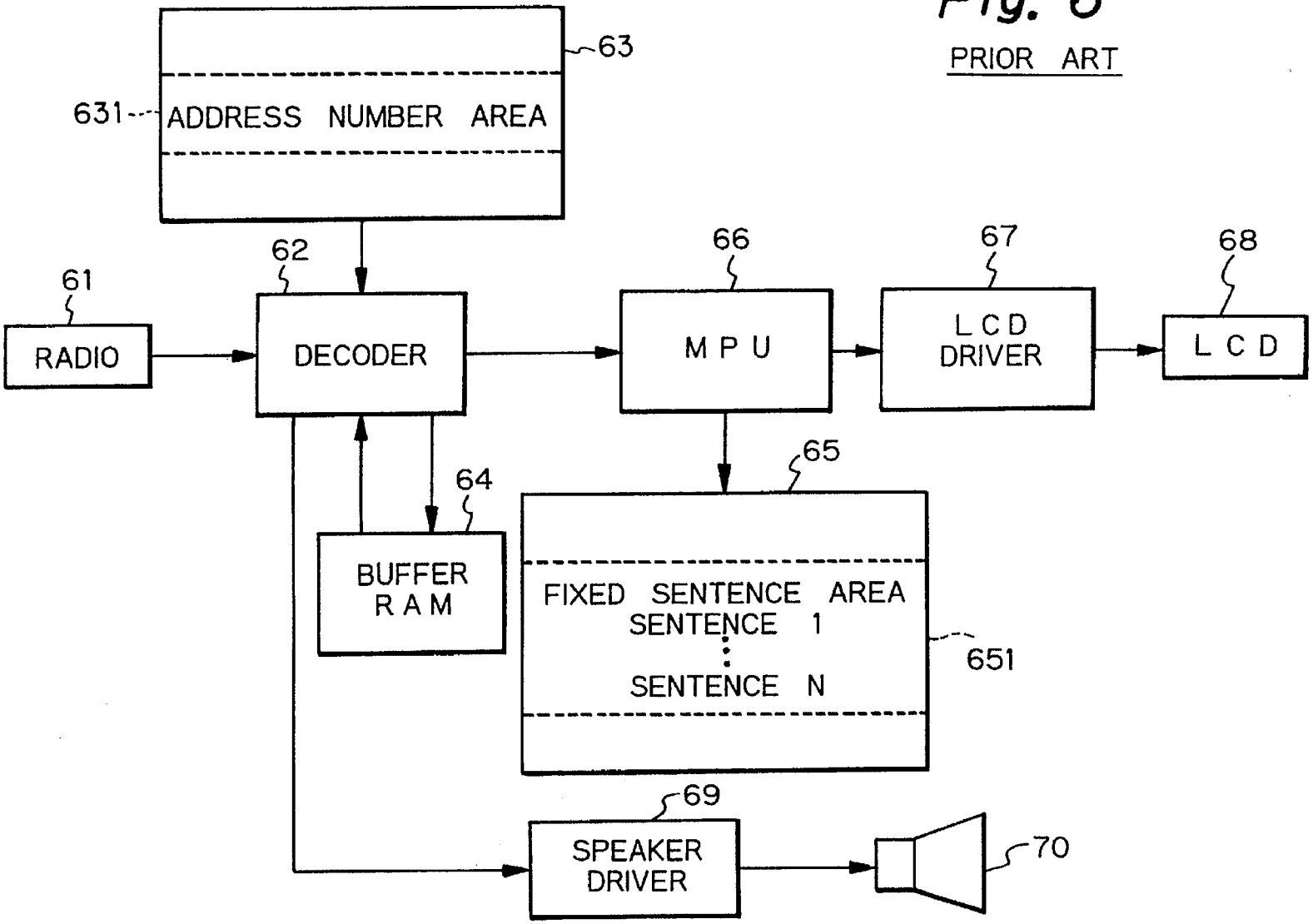
Fig. 6 PRIOR ART
FIG. 6 is a block diagram schematically showing a conventional radio pager.

To better understand the present invention, a brief reference will be made to a conventional radio pager having the capability to which the present invention pertains, shown in FIG. 6. As shown, the pager has a radio section 61 which amplifies a radio signal coming in through an antenna, not shown and demodulates the amplified signal while transforming the waveform thereof to one which a decoder 62 can read. An EEPROM (Electrically Erasable Programmable Read Only Memory) 63 stores an address number assigned to the pager. The decoder 62 reads the address number out of the EEPROM 63 and compares it with an address number included in the signal output from the radio section 61. If the two address numbers are identical, the decoder 62 writes message data following the address number in a buffer RAM (Random Access Memory) 64. At the same time, the decoder 62 causes a speaker driver 69 to drive a speaker 70 with the result that an alert tone is produced to alert the user of the pager to the incoming call. Further, the decoder 62 decodes the message data stored in the RAM 64 and feeds the decoded data to an MPU (Micro Processing Unit) 66. A ROM 65 includes an area 651 storing a plurality of fixed sentences 1-N. Assume that the decoded message data include a fixed sentence. Then, the MPU 66 reads all the fixed sentences 1-N out of the ROM 65 and compares them with the message received from the decoder 62, thereby selecting one of the former corresponding to the latter. The sentence selected by the MPU 66 is displayed on an LCD (Liquid Crystal Display) 68 via an LCD driver 67 as a message meant for the user.

The pager having the above construction is capable of selecting any one of the fixed sentences registered thereat without regard to the address number used to send a message to the user. All the sentences registered at the pager are candidates for message display. This brings about the problem discussed previously. Namely, the pager is apt to display an unexpected fixed message due to, for example, an incorrect sentence number inadvertently entered at the calling station and propagation troubles, e.g., wave interference and fading. For example, it is likely that "Charge is unpaid", which is an exclusive fixed message to be sent by the operator to a user, is sent by accident.

Figure 1:
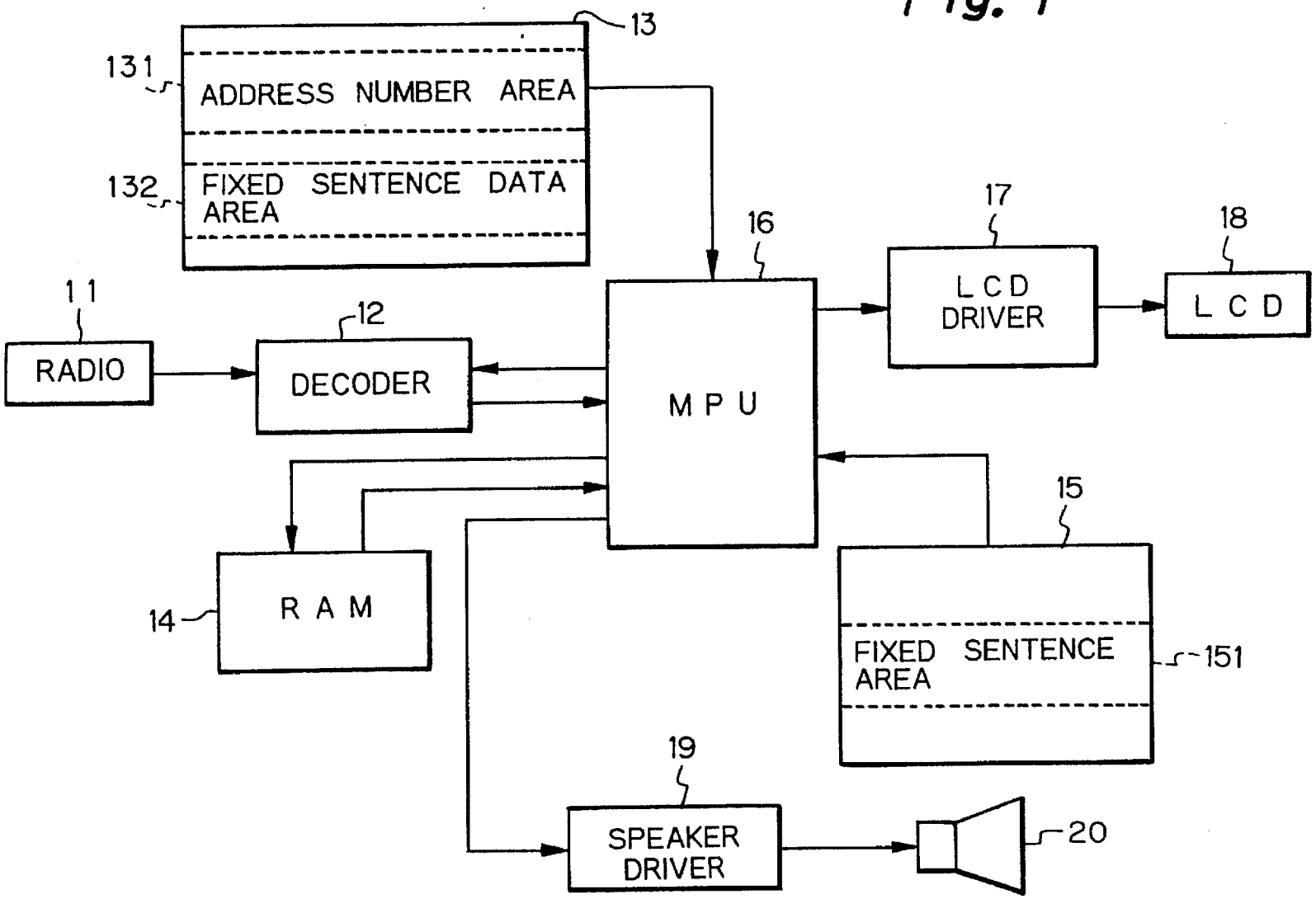
FIG. 1 is a block diagram schematically showing a radio pager embodying the present invention.
Figure 5:
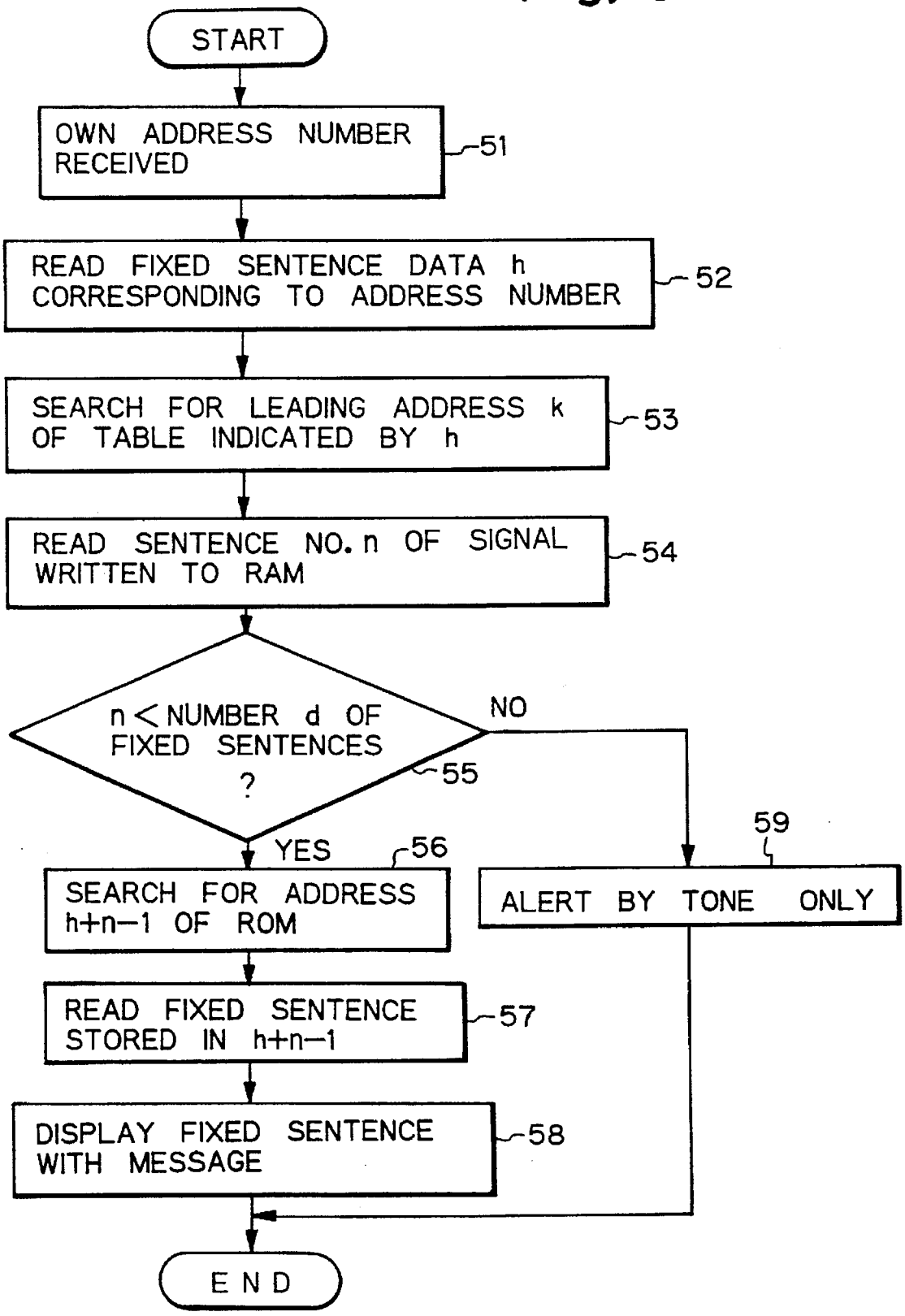
FIG. 5 is a flowchart demonstrating a specific operation common to both of the illustrative embodiments.

Referring to FIG. 1, a radio pager embodying the present invention is shown. The embodiment will be described with reference also made to a flowchart shown in FIG. 5. As shown, the pager has a radio section 11 playing the same role as the radio section 61 of the conventional pager. An EEPROM 13 includes an area 131 storing a plurality of address numbers. When an address number decoded by the radio section 11 is applied to a decoder 12, the decoder 12 writes it in a RAM 14 via an MPU 16 and compares it with the address numbers stored in the EEPROM 13. If the address number from the radio section 11 is identical with any one of the stored address numbers, the decoder 12 determines that it is the number assigned to the pager. Then, the decoder 12 causes a speaker driver 19 to drive a speaker 20 via the MPU 16, thereby alerting the user to the incoming call. This part of the procedure is collectively represented by a step 51 in FIG. 5. At the same time, the decoder 12 writes message data following the address number in the RAM 14.

A ROM 15 has an area 151 storing a plurality of fixed sentences in a format shown in FIG. 2. As shown, a plurality of tables (tables 1–3 in the figure) each storing a particular kind of fixed sentences are stored in the area 151 of the ROM 15. Addresses k, l and m are each indicative of the leading address of one table. Specifically, fixed sentences k[1] to k[d] belonging to the table 1 are sequentially stored in addresses k, k+1, . . . , k+d−1 in this order. Likewise, fixed sentences 1[1] to 1[e] belonging to the table 2 are stored in addresses l, l/+1, . . . , l+e−1. Further, fixed sentences m[1] to m[f] are stored in addresses m, m+1, . . . , m+f−1. The leading addresses k, l and m of the tables are respectively stored in addresses h, i and j of the area 151.

Figure 3:
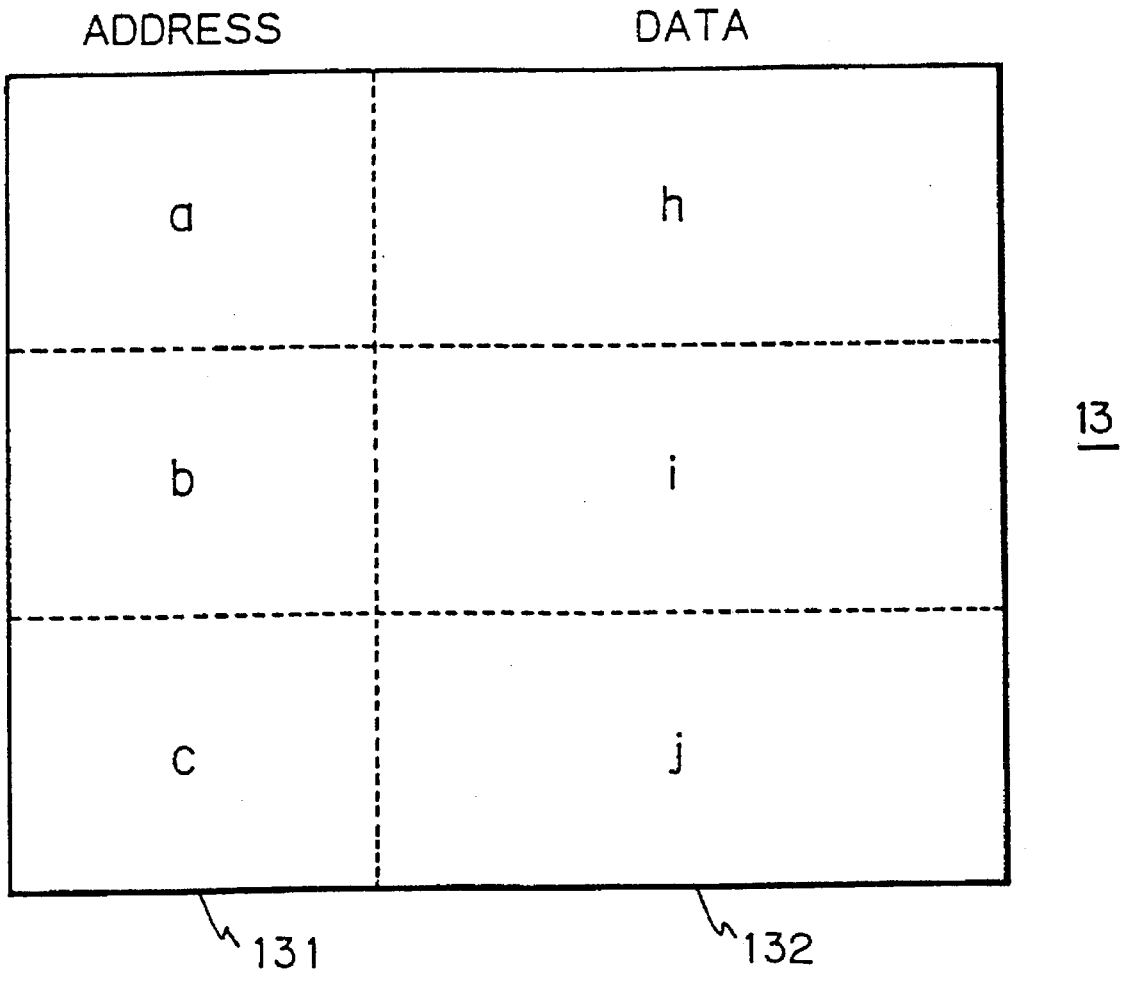
FIG. 3 shows fixed sentence data stored in a format also particular to the present invention.

The EEPROM 13, FIG. 1, has an area 132 storing the above-mentioned addresses h, i and j, in addition to the address number area 131. FIG. 3 shows a format in which the addresses h, i and j are stored in the area 132. As shown, the addresses h, i and j are respectively stored in addresses a, b and c of the area 132, i.e., as fixed sentence data each corresponding to one of the address numbers also stored in the EEPROM 13.

Referring again to FIGS. 1 and 5, assume that the received address number is identical with an address number a stored in the EEPROM 13. Then, the MPU 16 reads the data h, indicating the address storing the leading address k of the table 1, out of the address a of the EEPROM area 132 (step 52). Then, the MPU 16 searches for the address k of the table 1 stored in the address h of the ROM 15 (step S53). At the same time, the MPU 16 reads a number assigned to the fixed message data written to the RAM 14 (step 54). Assuming that the sentence number read out of the RAM 14 is "2" by way of example, the MPU 16 searches for the address k+2−1 of the ROM 15 (step 56) and reads the fixed sentence k[2] stored therein (step 57). The fixed sentence k[2] is transferred from the MPU 16 to an LCD driver 17. In response, the LCD driver 17 drives an LCD 18 to display the message meant for the user (step 58).

If the fixed sentence number n read out of the RAM 14 is greater than the number d of fixed sentences (NO, step 55), the MPU 16 determines that the sentence written to the RAM 14 cannot be displayed. In this case, the MPU 16 simply produces an alert tone via the speaker driver 19 and speaker 20, informing the user of the incoming call (step 59).

Figure 4:
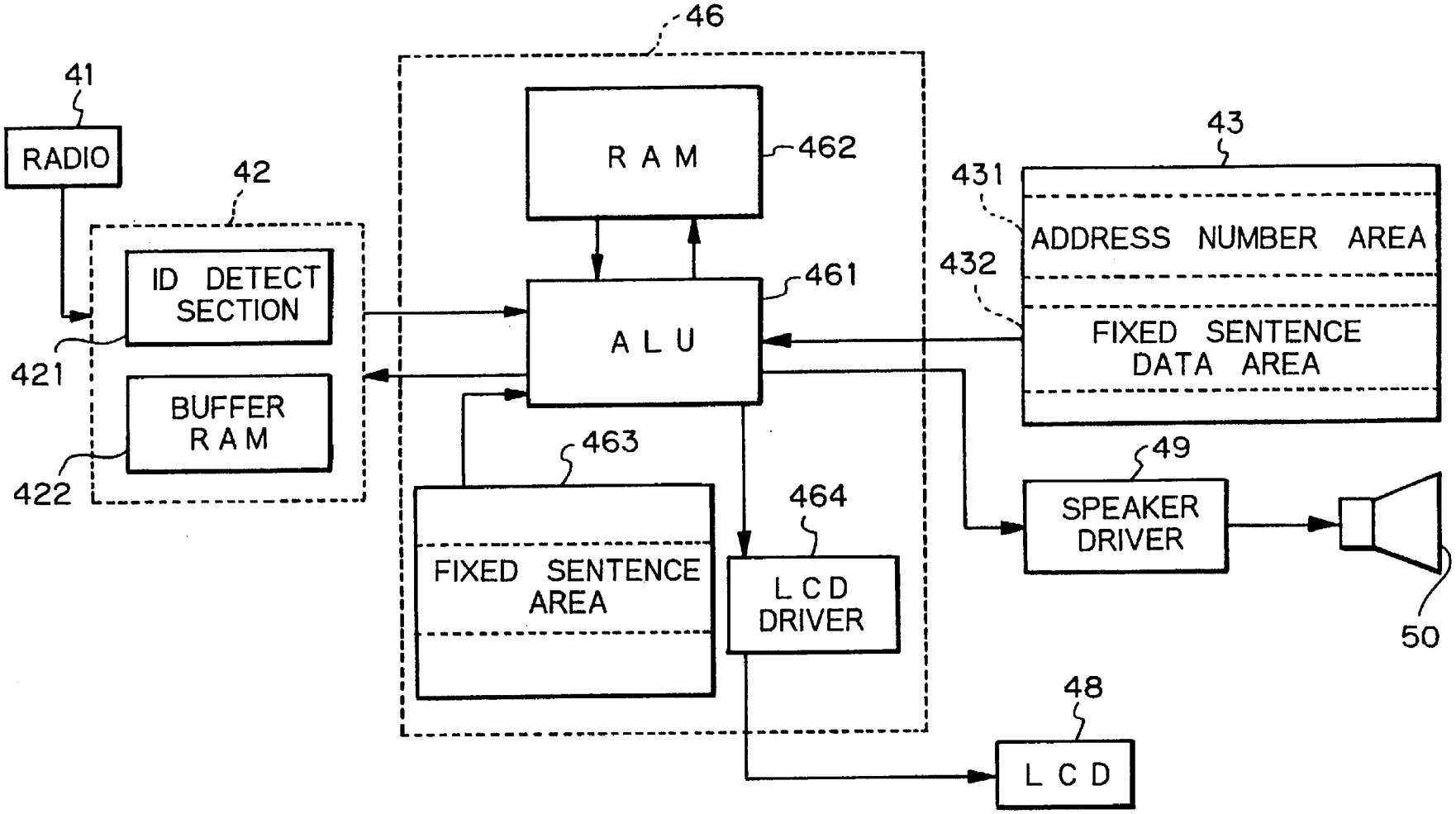
FIG. 4 is a schematic block diagram showing an alternative embodiment of the present invention.

Referring to FIG. 4, an alternative embodiment of the present invention will be described. The operation of this embodiment is the same as the operation of the previous embodiment and will also be described with reference made to FIG. 5. As shown in FIG. 4, the pager has an MPU 46 incorporating an ALU (Arithmetic and Logic Unit) 461, a RAM 462 for storing message data, a ROM 463, and an LCD driver 464 in a one-chip configuration. In this sense, the MPU 46 appears as if the RAM 14, ROM 15 and LCD driver 17 of the previous embodiment were built in the MPU 16 together. While the previous embodiment assigns the function of storing a received address number to the RAM 14, this embodiment assigns it to a decoder 42.

The ROM 463 of the MPU 46 also stores fixed messages in the format described with reference to FIG. 2. An EEPROM 43 has an area 432 storing the previously stated fixed sentence data in the format shown in FIG. 3.

In FIG. 4, a radio section 41 amplifies and demodulates a received radio signal while transforming the waveform thereof so as to allow the decoder 42 to read it. An ID (Identification) detecting section 421 is included in the decoder 42 and writes an address number decoded by the radio section 41 in a RAM 422, which is also included in the decoder 42. Further, the ID detecting section 421 compares the decoded address number with a plurality of address numbers stored in an area 431 which is included in the EEPROM 43. If the decoded address number is identical with any one of the stored address numbers, the ID detecting section 421 determines that the former is the number assigned to the pager and then alerts the user to the call via a speaker driver 49 and a speaker 50 (step 51).

Assume that the decoded address number corresponds to the address number a stored in the area 431 of the EEPROM 43. Then, the ALU 461 of the MPU 46 reads the data h out of the address a of the area 432 of the EEPROM 43 (step 52). As a result, the leading address k of the table 1 is read out of the address h of the ROM 463 (step 53). At the same time, the ALU 461 reads a number assigned to the fixed sentence written to the buffer RAM 422 (step 54). Assuming that the sentence number read out of the RAM 422 is "2" by way of example, the ALU 461 reads the fixed sentence k[2] out of the address k+2−1 of the ROM 463 (steps 56 and 57). The fixed sentence k[2] is written to the RAM 462 and, at the same time, transferred to the LCD driver 464. In response, the LCD driver 464 drives the LCD 48 to display the message meant for the user (step 58).

Again, if the fixed sentence number n read out of the RAM 422 is greater than the number d of fixed sentences (NO, step 55), the MPU 46 determines that the sentence written to the RAM 422 cannot be displayed. In this case, the MPU 46 simply produces an alert tone via the driver 49 and speaker 50, informing the user of the incoming call (step 59).

As stated above, the illustrative embodiment implements a small size, power saving, and low cost configuration since the ALU 461, RAM 462, ROM 463 and LCD driver 464 are constructed into a single chip.

In summary, it will be seen that the present invention provides a radio pager which does not display an unexpected message, which corresponds to an address number other than one assigned to the pager, despite the accidental entry of an unexpected sentence number at a calling station and various kinds of propagation troubles. This unprecedented advantage is derived from the fact that the pager selects a table corresponding to its own address number on the basis of a relation stored beforehand and selects out of the table a fixed sentence corresponding to a message written to a message memory.

Various modifications will become possible for those skilled in the art after receiving the teachings of the present disclosure without departing from the scope thereof.

What is claimed is:

1. A radio pager capable of displaying a fixed sentence, comprising:

a radio section for receiving and demodulating a paging signal;

a first storage for storing a plurality of address numbers allocated to said radio pager;

a comparing section for comparing an address number included in the paging signal demodulated by said radio section with each of the plurality of address numbers stored in said first storage, and for outputting, if said address number of said paging signal matches any one of said plurality of address numbers, said address number while writing message data following said address number in a message memory;

a second storage for storing a plurality of tables each listing a particular kind of fixed sentences;

a third storage, accessed by said address number, for storing a leading address data for each of said plurality of tables;

a message processing section for selecting, based on said leading address data stored in said third storage, one of said plurality of tables corresponding to said address number, and for selecting one of said fixed sentences corresponding to the message data written to said message memory; and a display section for displaying the fixed sentence selected by said message processing section.

2. A radio pager as claimed in claim 1, wherein said message processing section, said second storage, and a driver included in said display section for driving a display are configured as a single chip.

3. A radio pager as claimed in claim 1, wherein said first storage and said third storage comprise a single electrically erasable programmable read-only memory (EEPROM).

4. A radio pager as claimed in claim 3, wherein said second storage comprises a single read-only memory (ROM).

5. A radio pager as claimed in claim 4, wherein said message processing section comprises a micro processing unit (MPU), a decoder, and a random access memory (RAM).

6. A radio pager as claimed in claim 1, wherein contents for being displayed by said display section are limited in advance based on said address number assigned to said radio pager and with said second storage dealt with as a unit.

7. A radio pager as claimed in claim 6, further comprising means for limiting the contents in advance, said means for limiting including a fixed sentence data area included in said second storage.

8. A radio pager comprising:

a radio section for receiving and demodulating a paging signal;

address number storage means for storing a plurality of address numbers allocated to said radio pager;

a match detecting section for comparing a demodulated address number included in the demodulated paging signal with the plurality of address numbers stored in said address number storage means, said match detection section for outputting, when the demodulated address number matches any one of the plurality of address numbers, said demodulated address number as an address number assigned to said radio pager while writing message data following said address number in a message memory;

fixed sentence storage means for storing a fixed sentence selected on the basis of the message data written to said message memory; wherein said fixed sentence storage stores a plurality of tables each listing a particular kind of fixed sentences;

fixed sentence information storage for storing correspondence between the plurality of address numbers allocated to said radio pager and said plurality of tables; and a message processing section for selecting, based on said correspondence stored in said fixed sentence information storage, one of said plurality of tables corresponding to said address number assigned to said radio pager, and selecting one of said fixed sentences corresponding to the message data written to said message memory, and outputting the one fixed sentence to said display section.

9. A radio pager as claimed in claim 8, wherein said message processing section, said fixed sentence information storage, and a display driver included in said display section are included in a single chip.

* * * * *